US005748083A

United States Patent [19]

Rietkerk

[11] Patent Number: 5,748,083

[45] Date of Patent: May 5, 1998

[54] COMPUTER ASSET PROTECTION APPARATUS AND METHOD

[75] Inventor: Anthony J. Rietkerk, Hollister, Calif.

[73] Assignee: Security Solutions Plus, Santa Clara, Calif.

[21] Appl. No.: 615,784

[22] Filed: Mar. 11, 1996

[51] Int. Cl.[6] ..... G08B 13/14

[52] U.S. Cl. ..... 340/568; 340/571; 340/687

[58] Field of Search ..... 340/539, 568, 340/571, 687

[56] References Cited

U.S. PATENT DOCUMENTS

| | | | |
|---|---|---|---|
| 4,523,184 | 6/1985 | Abel | 340/539 |
| 4,737,770 | 4/1988 | Brunius et al. | 340/539 |
| 4,823,280 | 4/1989 | Mailandt et al. | 364/514 |
| 4,897,630 | 1/1990 | Nykerk | 340/460 |
| 4,951,029 | 8/1990 | Severson | 340/506 |
| 5,406,256 | 4/1995 | Ledel et al. | 340/539 |
| 5,406,261 | 4/1995 | Glenn | 340/571 |
| 5,438,607 | 8/1995 | Przgoda, Jr. et al. | 379/38 |

OTHER PUBLICATIONS

Interactive Technologies inc. "The SX-V Security System" marketing brochure 46-116 ©1989 ABM Data Systems, Inc. ABM-PC All You Need to Grow brochure (unknown publication date).

*Primary Examiner*—Jeffery Hofsass
*Assistant Examiner*—Edward Lefkowitz
*Attorney, Agent, or Firm*—R. Michael Ananian; Flehr Hohbach Test Albritton & Herbert LLP

[57] ABSTRACT

An advanced asset protection system (APS) includes a small, battery-powered, Asset Protection Device (APD) having circuits for detecting motion and tampering and intrusion of a protected asset or the APD itself. The APD includes a an internal wireless battery-powered transmitter that transmits security system status information such as information that an alarm condition was sensed, or that a tamper condition was sensed, and an APD identifier to a wire-less receiver. It includes a switch configurable multi-port connector module that provides a plurality of asset coupling ports for electrically coupling assets to the APD modular telephone wire. Ports present but not used, are disabled (to prevent false tamper or alarm reports) by port by-pass circuitry. The APD effectively extends the tamper and alarm circuits to remotely connected assets via the multi-port connector. The APD provides a motion sensitivity adjustment circuit, including a configurable bank of capacitors across a mercury switch, that provides for selectable motion detection sensitivity by adjusting the delay period between the initial disturbing motion and an alarm indication. The APD and the APD sensors are themselves protected from electrical and mechanical intrusion of the housing, physical removal from an asset, electrical manipulation of the coupling cords or remote asset protection sensors attached to the assets, or removal of the sensors from a protected asset.

21 Claims, 13 Drawing Sheets

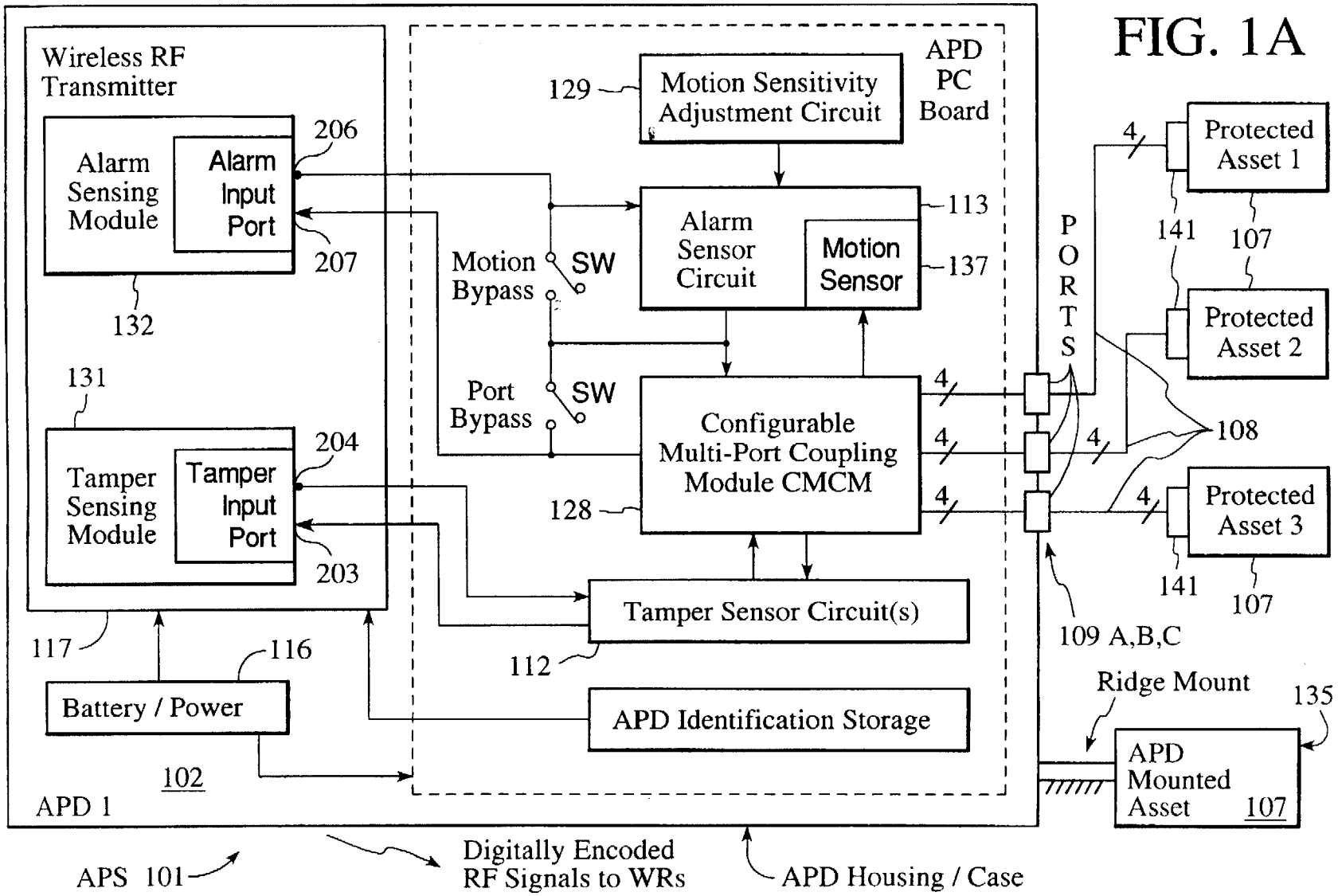
FIG. 1A
Protected Asset 1
Protected Asset 2
Protected Asset 3
107
141
108
4
PORTS
109 A,B,C
Ridge Mount
135
APD Mounted Asset
107
APD PC Board
Motion Sensitivity Adjustment Circuit
129
Alarm Sensor Circuit
Motion Sensor
113
137
Configurable Multi-Port Coupling Module CMCM
128
Tamper Sensor Circuit(s)
112
APD Identification Storage
SW
Motion Bypass
Port Bypass
APD Housing / Case
Digitally Encoded RF Signals to WRs
Wireless RF Transmitter
Alarm Input Port
Alarm Sensing Module
206
207
132
Tamper Input Port
Tamper Sensing Module
204
203
131
117
Battery / Power
116
102
APD 1
APS 101

COMPUTER ASSET PROTECTION APPARATUS AND METHOD

FIELD OF INVENTION

The invention pertains generally to physical asset protection, and more particularly to protective apparatus and method for identifying alarm and/or tamper conditions when a protected asset is physically moved or detached from the protective apparatus or otherwise disturbed, or when the asset protection apparatus is tampered with.

BACKGROUND OF THE INVENTION

The physical security of personal and corporate property, particularly expensive electronic goods, has become increasingly important as the number and value of such goods has increased. Computers, video cameras, printers, and scanners, are increasingly available in the home and business environment. The sophistication of laptop and notebook computers is particularly problematic because such computers may easily cost 5,000 or more and are easily moved and concealed, such that they can be removed from the premises unless some additional security is provided. Even larger desk-top computers are susceptible to theft; either the entire unit may be stolen or with increasing likelihood the valuable internal components such as the central processing unit (CPU) chip or memory chips may be removed after the exterior cover has been removed. The developing trend toward storing vast amounts of personal and business data and software on a computer hard disc drive makes theft and tamper prevention all the more important. Most such asset thefts are never solved, and the property is rarely recovered. Therefore there is a need to protect an asset, such as a computer or associated peripheral, from being stolen or otherwise removed from its proper location and from tampering, including being opened to remove valuable components, and for protecting the security apparatus itself from tampering.

For notebook computers which are intended to be used at a variety of locations, there are advantages to a security system that permits authorized removal and disconnection of the computer from the security system or network so that the computer can be removed without undue burden on the user or on the company security team. The potentially large number of assets to be protected benefits from a low cost modular security system that can protect one or any number of assets. Therefore, there is a continuing need for an electronic asset protection device that is simple and therefore relatively low cost, wireless, easily reconfigurable to meet changing needs, and modular so that it may be easily expanded.

SUMMARY OF INVENTION

The inventive apparatus and method provide an advanced asset protection system (APS) that includes a small, battery-powered, Asset Protection Device (APD) having means for detecting motion of protected assets, means for detecting tampering of the protective apparatus, and means for detecting any tampering of the asset protection equipment. The APD advantageously may include an internal wireless transmitter that transmit security system status information. For example, the inventive apparatus includes a wireless transmitter for transmitting APD status information indicating that an alarm condition is sensed (for example, equipment disruption or motion detected), that a tamper condition is sensed, and APD identifier information to a Wire-less receiver within the facility where the APD is maintained.

The APD is self-contained and need not electrically connect to a protected asset. The inventive APD also advantageously includes a configurable multi-port connector module that provides a plurality of asset coupling ports for coupling assets to the APD via 2- or 4-conductor wire. Advantageously, the detection and signaling circuits described herein permit the assets to be coupled to the APD using inexpensive modular telephone attachment cords to securely couple the assets to the APD. A single APD provides connectivity and protection for multiple assets, limited only by the number of APD ports provided. One small APD unit provides three ports, but additional ports may easily be configured, and ports present but not used, may be disabled (to prevent tamper or alarm conditions) by port by-pass circuitry. The inventive APD effectively extends the tamper circuit contained within the APD housing to remotely connected assets via a multi-port connector and connector cord.

The inventive APD provides a motion sensitivity adjustment circuit that provides for selectable motion detection sensitivity by adjusting the delay period between the initial disturbing motion, such as the change in the open/closed state of a mercury switch, by varying the capacitance in a bank of capacitors. The sensitivity may be adjusted to provide a relatively low sensitivity (long delay) if the equipment is routinely subject to occasional bumps so that the false alarm rate is reduced to a tolerable level without sacrificing security. The inventive APD master module and the APD sensors are themselves protected from electrical and mechanical intrusion of the APD housing, physical removal of the APD unit from an asset, electrical manipulation of the coupling cords or remote asset protection sensors attached to the assets, or removal of the sensors from a protected asset.

DESCRIPTION OF PREFERRED EMBODIMENTS OF THE INVENTION

Figure 1:
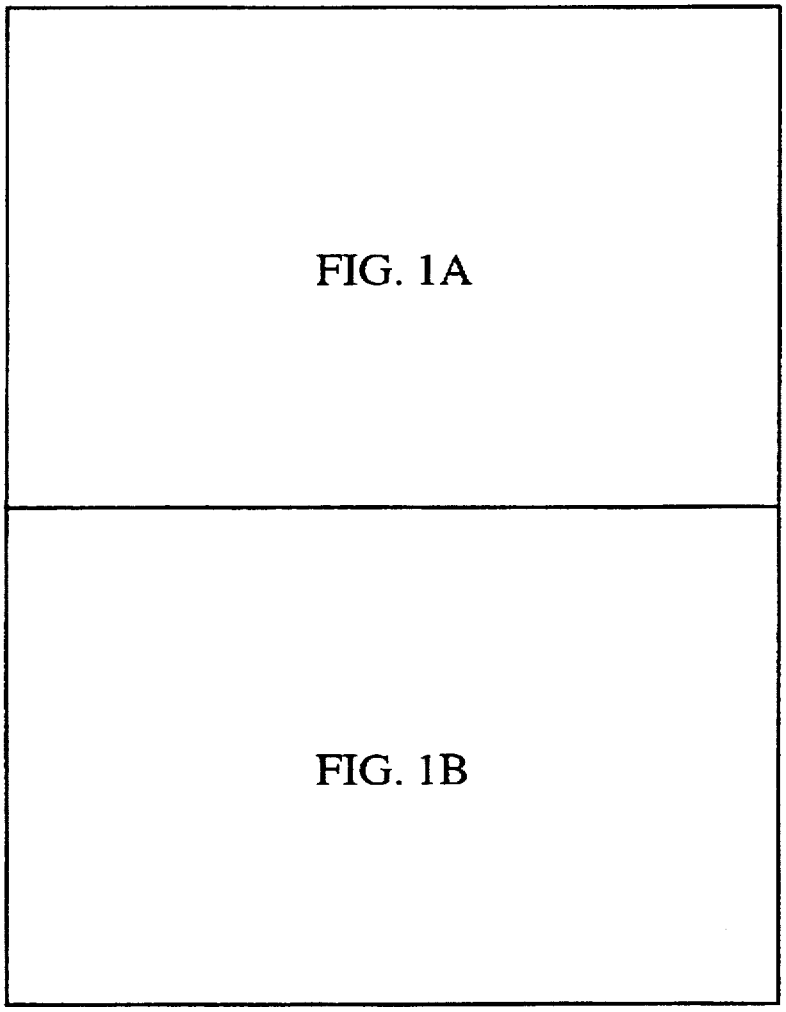
FIG. 1 is a functional block diagram illustrating components of an embodiment of the inventive Asset Protection System (APS) particularly including an Asset Protection Device (APD).
Figure 1B:
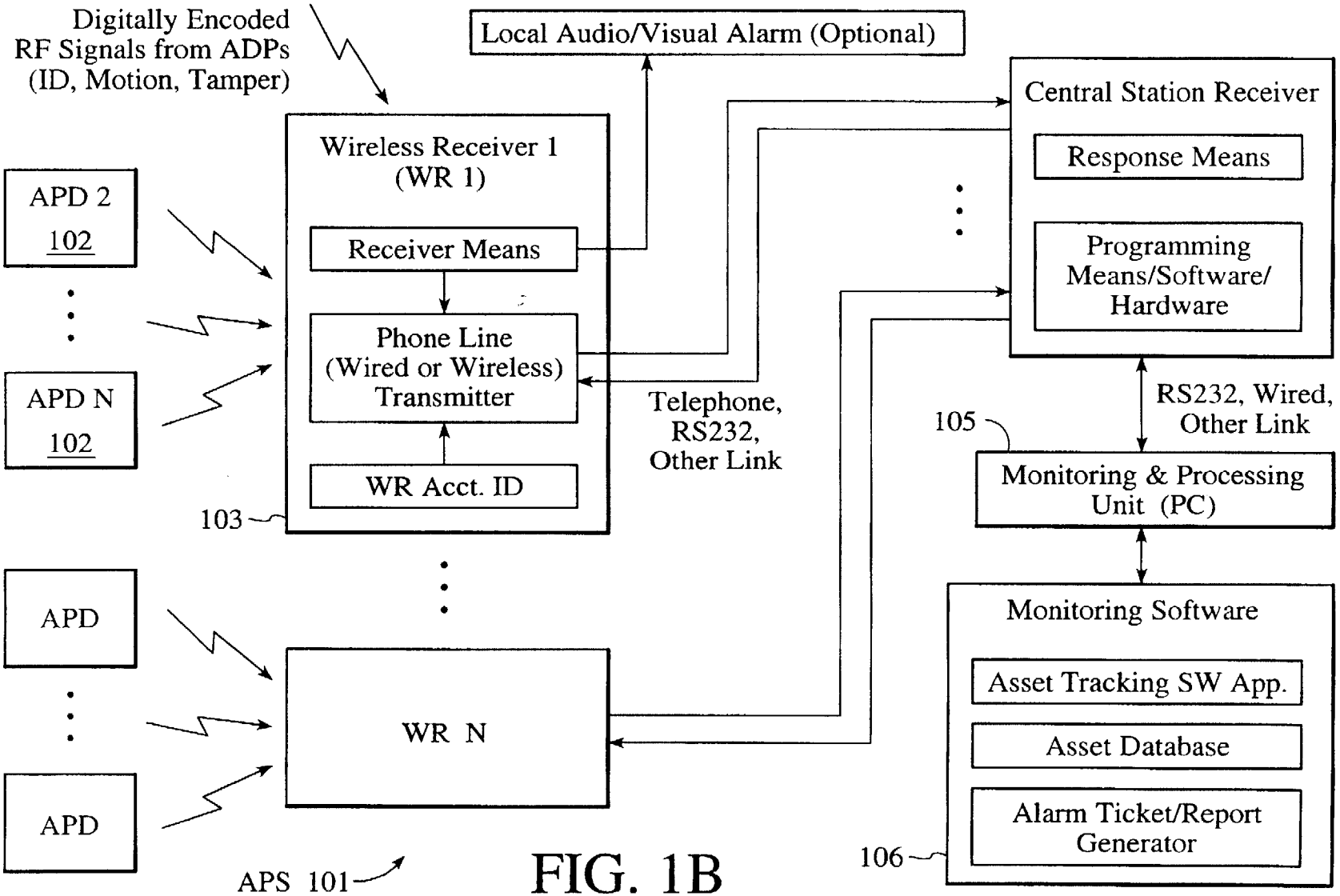
Figure 2:
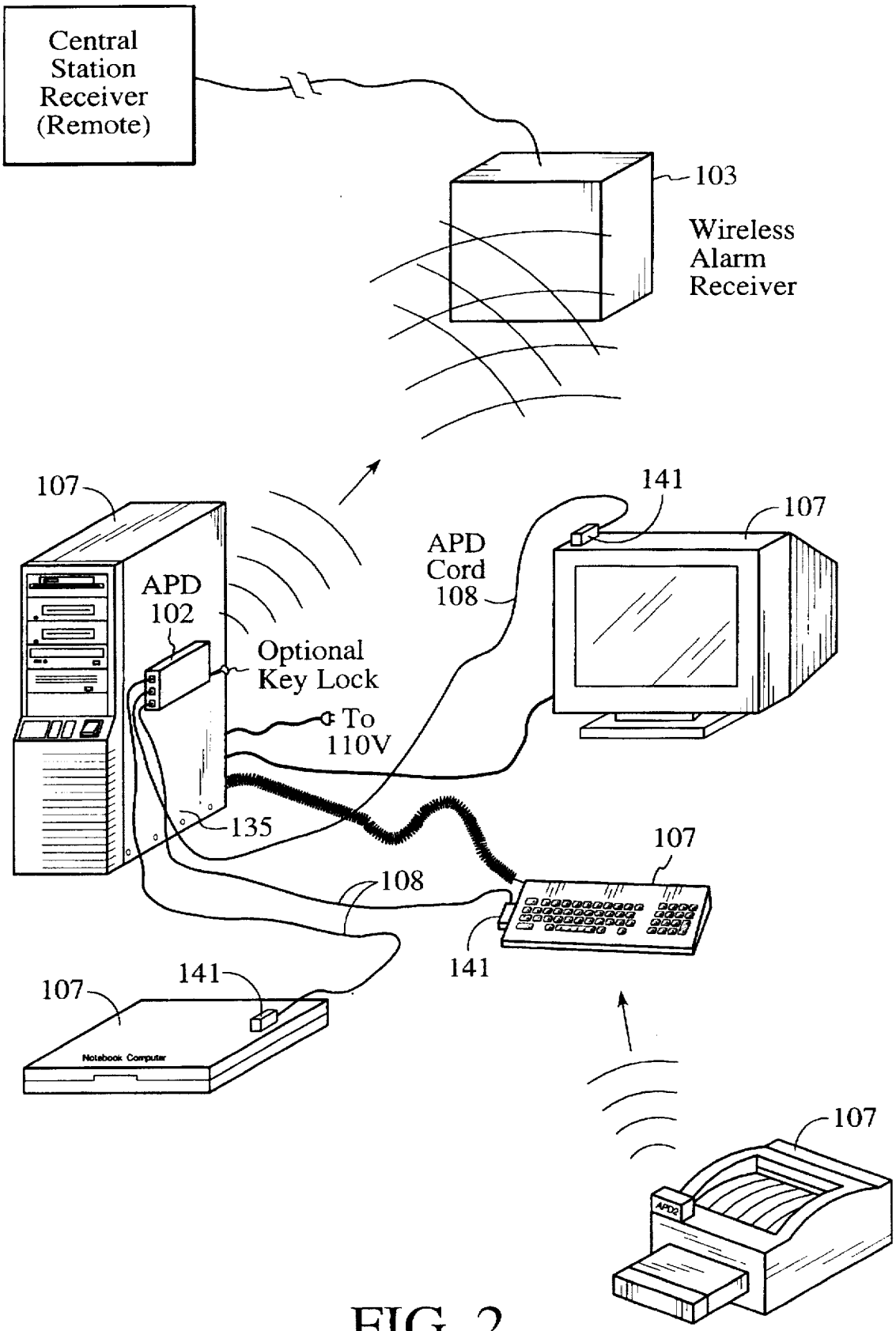
FIG. 2 is an diagrammatic illustration of a portion of the APS system in FIG. 1 showing the relationship between the APD and several protected assets.

With reference to FIG. 1, there is shown a system block diagram for an embodiment of the inventive Asset Protection System (APS) 101. FIG. 2 provides a diagrammatic illustration of a physical configuration of an embodiment of the inventive system showing the major components and their connectivity to protected assets. APS 101 comprises four primary components including at least one battery powered Asset Protection Device (APD) 102, at least one Wireless Receiver (WR) 103 associated with the APD 102, an optional Central Station Receiver (CSR) 104, and an optional Processing Unit 105 including Operating and Monitoring Software components 106 at a remote monitoring and processing facility. A preferred embodiment of APS 101 includes all four components. Multiple APDs 102 and WRs 103 may be provided. Each asset 107 protected by APS 101 is integrated into the APS 101 either by physically (mechanically) attaching the APD 102 to the asset or by connecting the asset physically to an APD Sensor 141 and the APD sensor 141 to the APD via an electrical connecting cord 108 through one of electrical coupling ports 109A, 109B, and 109C. More or fewer coupling ports, including no ports where the APD is only mechanically attached to the asset, may be provided. The details of each APS 101 component and the interconnectivity of the APS components and protected assets 107 are described in greater detail hereinafter.

Commercial wireless transmitters, such as are commonly employed in security and asset protection system are capable of transmitting either or both of two signals: (1) an alarm signal, and (2) a tamper signal. In general, according to conventional usage, a tamper type signal is sent repeatedly (e.g. at a predetermined repeating rate or alternatively, more or less continuously) until the cause of the tamper condition is cured. Curing the tamper condition typically requires investigation of the asset locale by an investigator or security officer. An alarm-type signal is generally understood to mean a signal that is generated only at the initiation of the alarm condition, that is as a one-shot event. Such a one-shot is self-curing, and may not be investigated. For example, if a motion of the equipment is signaled, the alarm condition is transmitted, but once the motion stops so does the alarm. These conventions are described here as an aid to understanding the configuration of the alarm and tamper portions of the APD. The wireless transmitter may be provided in the APD 102 such that it transmits an alarm and/or tamper type signal for any predetermined circumstances, such signals being any combination of one-shot and repeating signals. Therefore, although the invention is described in terms of alarm and tamper type signals, it will be understood by those having ordinary skill in the art in light of the description herein, that the apparatus and method of the invention may be practiced with alarm or tamper type signaling.

A single zone condition (alarm and tamper) transmitter 117 is configured to receive a first input from alarm sensing module 132 (condition 1) and a second input from tamper sensing module 131 (condition 2). The wireless transmitter 117 is configured to transmit an alarm condition when the input to the alarm port has appropriate electrical characteristics, such as a change in voltage or current characteristics across the two terminals of the alarm input port, as described subsequently. In an analogous manner, transmitter 117 is configured to report a tamper condition when the input to the tamper input port has appropriate electrical characteristics. The tamper and alarm transmissions have different signal characteristics and when received by wireless receiver 103, these differences are interpreted and decoded as alarm or tamper conditions for the particular zone. For example for an APD configured as a particular zone, the wireless transmitter 117 transmits a digital encoded Radio Frequency (RF) signal identifying the condition and the particular zone.

In conventional security systems, a motion sensor is coupled to the transmitter 117 alarm sensing module circuit 132 to provide a one-shot signal for each detected motion, and tamper detection circuits are typically coupled to a tamper-type sensing module circuit so that a repeating transmission is sent until the tamper condition is investigated and the tamper condition is reset. Several embodiments of the invention are described that retain this motion sensor connectivity to the alarm circuit; however, it should be understood that the motion detector may be configured to either transmitter 117 input port.

A protected asset 107 is any item that has been connected to the APS such that the asset is protected. For example, the asset may be protected in a manner that movement of the item, physical or electrical disconnection of the item from the APD, or tampering of the APD and associated components including damage or disruption of the components generates an alarm condition signal, a tamper condition signal or both. Typically, the protected asset will be a desktop computer, a notebook computer, a laptop computer, and/or one or more computer peripherals, other electronic, optical, or mechanical equipment, and the like. An APD may also be installed in conjunction with external motion detection equipment, Infrared sensors, magnetic switches such as may be used to monitor door and window closure and other devices that present or can be made to present a closed circuit and an open circuit (e.g. a switch). The APD is not dependent on any particular electrical characteristics of the protected asset for operation, although some embodiments of the APD may be fabricated such that the APD 102 may be installed internal to an asset, such internal installation in not preferred because of the potential disruption in asset use during installation and maintenance and the potential liabilities associated with installation into another manufacturer's product. The APD is preferably small and unobtrusive. One embodiment of the APD is about 4" by about 2"×about 1", but smaller form factor APDs may be fabricated so long as they provide sufficient surface areas for the coupling ports 109, and sufficient interior volume for the circuitry. Of course, the housing should be transmissive to the internal wireless transmitter, such as a plastic housing.

With further reference to FIG. 1, an embodiment of Asset Protection Device 102 is now described. The APD provides security for each connected asset by providing a motion sensing device 137 and associated motion sensing or detection circuitry 113 that detects motion of the APD 102 and the asset physically attached to the APD. The motion sensing circuitry 113 couples to the alarm sensing module 132 (e.g. condition 1 port). The alarm sensing module 132 is also coupled to and receives signals from each protected asset through disruption detection circuits 174 as illustrated, for example, in FIGS. 9 and 13. The motion detector and disruption circuits are coupled serially to each other so that either motion or circuit disruption results in an alarm condition. These disruption circuits detect physical or electrical tampering or disruption of the electrical coupling of the assets attached to the APD via coupling cords or wires 108 extending to each protected asset and an APD sensor (APDS) 141 or laptop asset sensor (LAPDS) 142.

Figure 4A:
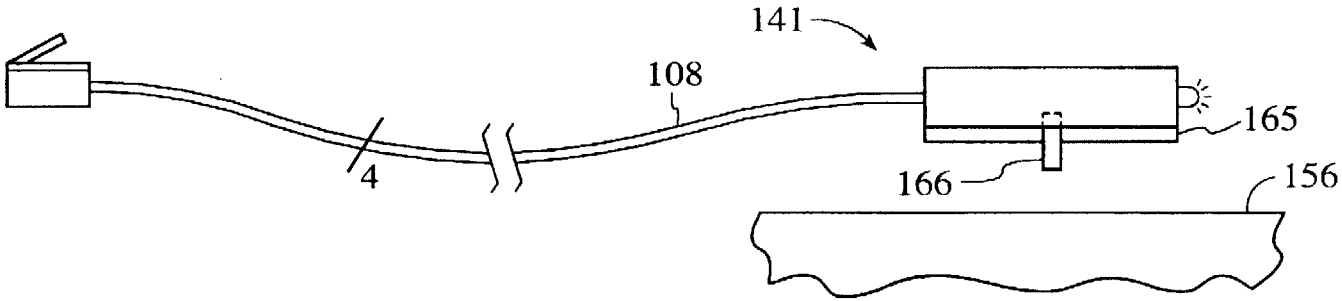
FIG. 4*a* is a diagrammatic illustration showing an embodiment of the Asset Protection Device Sensor (APDS) prior to being attached to, or after removal from, an asset so that a spring-loaded switch plunger is in an extended position and can signal an alarm.
Figure 4B:
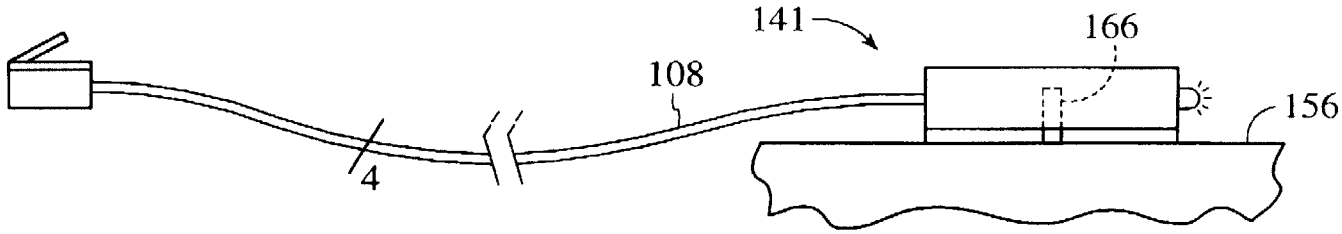
FIG. 4*b* is a diagrammatic illustration showing the manner in which an embodiment of the Asset Protection Device Sensor (APDS) shown in FIG. 4*a* is mechanically attached to an asset so that the spring-loaded switch plunger is in a retracted position and does not signal an alarm.
Figure 5B:
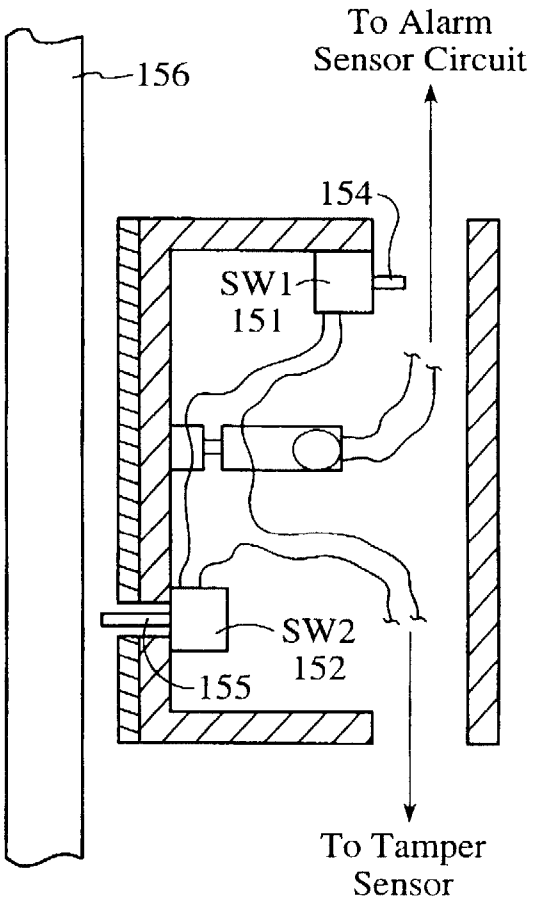
FIG. 5*b* is a diagrammatic illustration showing a partial sectional view of an embodiment of the APD module in FIG. 5*a* and showing details of the APD cover and APD housing anti-tamper switches and mercury switch motion sensor.
Figure 5A:
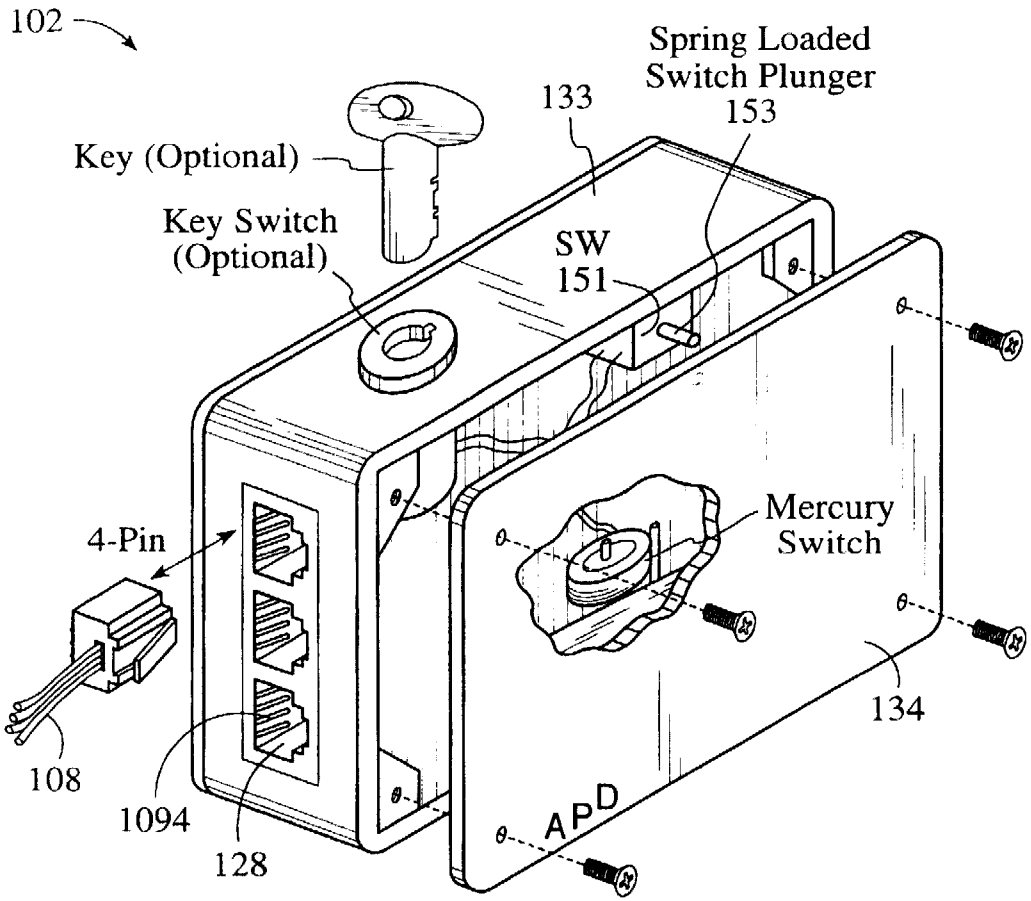
FIG. 5*a* is a diagrammatic illustration showing a perspective view of an embodiment of a particular Asset Protection Device (APD) module showing particularly the manner in which the APD is protected from tampering by removal of the cover or by removal of the APD from the protected asset.

The electrical and physical characteristics of embodiments of the APDS and LAPDS are illustrated diagrammatically in FIGS. 3 and 4; the electrical and physical characteristics of the APD tamper sensors 151, 152 are illustrated in FIG. 5; and both are described in greater detail hereinafter. Tamper Sensor circuit is coupled to an APD tamper detection circuit (See FIGS. 6, 12 and 13, for example), and detects tampering of the APD itself (such as intrusion into the APD housing, and/or a physical removal of the APD from the asset). In the preferred embodiment of the APD, an asset tamper detection circuit is also extended from the transmitter 117 inside the APD housing through 2-wires of a 2-, 4-, or 6-wire electrical cord 108 to the APDS or LAPDS 141 sensor vial the multi-port connector module 128 of APD 102. This configuration provides redundant tamper and alarm protection for each cord 108 coupled asset, each of the tamper and alarm circuits using 2 of the available 4 wires in cord 108.

The alarm sensor circuit 113 and tamper circuit 112 communicate alarm condition and tamper condition respectively to a alarm sensing module 132 or tamper sensing module 131 within Wireless Transmitter 117. Transmitter 117 transmits a digitally encoded signal, identifying whether the transmission event is for an alarm detection condition (e.g. motion or circuit disruption) or a tamper condition (e.g. APD removal, APD intrusion, cord electrical damage, APDS or LAPDS removal) and the unique identity of the APD sending the transmission, which is received by Wireless alarm Receiver 103.

The APD is nominally a low power consumption device, and such power is provided by the battery/power circuit 116, such as a 3.6-volt Lithium Battery. Because of the desirable low power nature of the APD 102, the Wireless Receiver 103 receiving the alarm and/or tamper signals is normally located in the general vicinity of the APD, for example in the same room or an adjacent room. Each APD 102 also has a unique identification (ADP ID) encoded in the unit. Wireless Transmitter 117 receives the APD ID when either or both of the alarm sensing module 113 and the tamper sensing module 112 transmit. The APD ID provides information that permits the Central Station Receiver 104 and the Processor Unit 105 including Monitoring Software 106 to dispatch security personal to the location of the alarm and/or tamper condition, and to produce alarm/tamper tickets and reports at the remote facility.

Wireless Receiver 103, may also respond to receipt of an alarm and/or tamper condition by initiating activation of an audible or visual signal and/or by activating a telephone line transmitter (for example, a modem) to send an alarm message over a communication link, such as a telephone line, RS-232 channel, or other like means, to Central Station Receiver (CSR) 104. Each WR 103 advantageously has a unique identification code, referred to as the Account ID programmed within it. CSR 104 may be provided at a central location within a facility and be connected to several such WAR's provided at different locations (e.g. rooms) within the same facility (e.g. building or clusters of buildings) or remotely.

APS 101 may be configured with a plurality of WR 103 and a further plurality of APDs 102 associated with each WR 103. The WR Account ID and the APD ID provide information means that enables rapid and appropriate response when an alarm or tamper condition are signaled and received. The APD ID and the WR Account ID may be provided in any conventional manner such as by setting a bank of switches, by programming an EEPROM, or by providing a unique ID for each APD or WR unit during manufacture and then reading that ID during APS system set-up and configuration to configure any particular preset ID with other system components.

Each CSR 104 is in turn connected via a telephone line, RS-232, cellular telephone, wireless RF-link, or other communication channel to a Processor 105 at a Monitoring Station. The Monitoring Station, may for example, be a corporate security headquarters, an off-site security contractor facility, a police or other law enforcement facility, or any other like facility provided for monitoring asset status. Preferably, CSR 104 is programmable to allow a user to program the desired location of the Monitoring Station (e.g programmable telephone number and message characteristics), and the Monitoring Software 106 provided in association with Processor 105 at the monitoring Station includes an Asset Tracking Application 121, an Asset Database and Database Access Program 122, and an alarm/tamper Ticket Generator Application Program 123.

Asset Tracking Application Software 121, the Asset Database and Database Access Program 122, and the alarm/tamper Ticket Generator Application Program 123 are commercial products available from ABM Data Systems, Inc. Of 9020 Capital of Texas Highway North, Suite 540, Austin, Tex. 78759.

The preferred embodiment of the inventive APD 102 provides several advanced and desirable features. First, the APD is small, battery-powered, and includes an internal wireless transmitter 117 to transmit status information (alarm sensed, tamper sensed, APD ID) to the WR 103 (typically mounted on a wall of the facility). Second, the APD includes a configurable multi-port connector module 128 that provides a plurality of asset coupling ports (e.g. 109A, 109B, and 109C) for electrically coupling assets to the APD. Advantageously, the alarm sensing module circuits and the tamper sensing module circuits permit the assets to be coupled to the APD using inexpensive attachment cords to securely couple the assets to the APD. For example, 4-conductor (2-conductor wire is sufficient for some embodiments) phone cord provides two wires for each of two independent circuits to/from the multiport connector 128 and an APDS 141 attached to an asset. The coupling may advantageously use the conventional phone cord clipconnectors, such as used for RJ-11 modular phone cords, handsets, and the like. Third, a single APD 102 provides connectivity and protection for multiple assets, limited only by the number of APD ports 109 provided. One embodiment of the APD provides three two-terminal ports, but additional ports may easily be configured. The details of the port structure are described in greater detail hereinafter. Fourth, the inventive APD provides a sensitivity adjustment circuit 129 that provides for selectable motion detection sensitivity by adjusting the delay period between the initial disturbing motion, such as the change in the open/closed state of a mercury switch, by varying the capacitance in a bank of capacitors coupled in parallel across the mercury switch (SW5). The sensitivity may be adjusted for a relatively low sensitivity (long delay) if the equipment is routinely subject to occasional bumps so that the false alarm rate resulting for example, from minor bumps or vibrations of the APD is reduced to a tolerable level without sacrificing security. Fifth, the APD unit 102 and the APD sensors are themselves protected from electrical and mechanical tampering by tamper sensor circuits that sense tampering of the APD housing, physical removal of the APD unit from an asset, electrical tampering of the coupling cords 108, electrical tampering of the APDS or LAPDS sensors attached to the assets, or removal of the APDS or LAPDS from an asset (See FIGS. 4 and 5). Finally, the APD 102 and assets are redundantly protected by the aforedescribed disruption detection circuits. The redundant protection also means that the one-shot alarm (if so configured) and the repeating tamper alarm (if so configured) are both provided. Repeating type alarms are advantageous since it provides greater deterrent effect from theft and vandalism and may even increase capture of suspected thieves on site.

Figure 6:
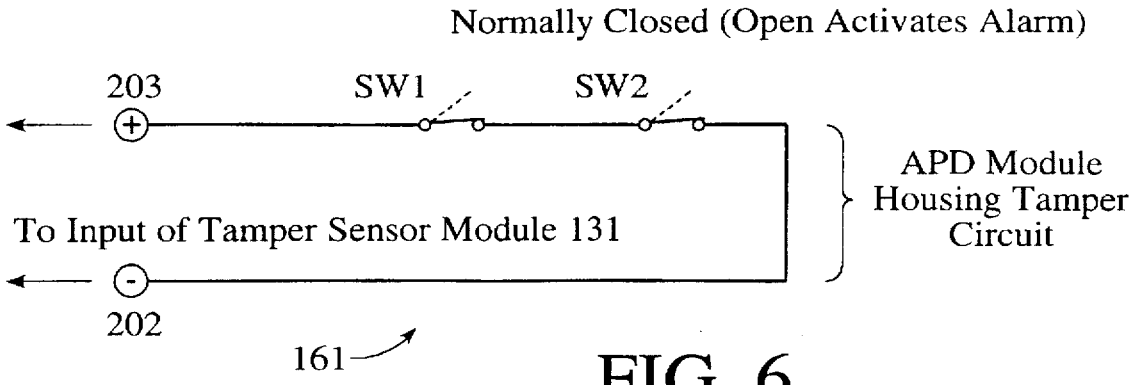
FIG. 6 is a schematic illustration of the equivalent electrical circuit for the APD module anti-tamper circuit shown in FIG. 5.

With respect to the embodiment illustrated in FIG. 6, there is shown an embodiment of the equivalent electrical circuit of APD tamper circuit 161. Switches SW1 and SW2 are serially coupled and correspond to the housing tamper micro-switch SW1 151 and the APD unit removal detection switch SW2 152 shown in FIG. 5. For each of these switches SW1 and SW2, the normally extended spring-loaded plungers 154, 155 are depressed either by the lid 134 or by contact with the protected mechanically mounted asset, and the switch is normally closed in this state. If the lid is removed, plunger 154 can extend thereby opening switch SW1. In similar manner, if the APD unit is removed from the surface of the protected asset 156, plunger 155 can extend, thereby opening switch SW2. In either case the circuit opens, current flow stops, and a voltage potential develops between port terminals 203 and 204 which are coupled to input terminals of tamper sensing module 131 (See, for example, FIGS. 1 and 12.).

An APD configuration may contain different sensing circuits that detect disruption of the tamper or alarm circuits or removal of the APDS or LAPDS sensors from the asset through the tamper and alarm conditions. Various sensor circuits for these functions are now described in greater detail with respect to FIGS. 6–9 and 11–13. Each of the circuits essentially comprises means for detecting a significant change in electrical characteristics or a break in electrical continuity between two terminals. One circuit monitors the electrical connection and protects the assets coupled to the APD unit via electrical cords 108. Another circuit 163 monitors the physical (and electrical) connection between the asset and the ADP sensor or APD Laptop sensor attached to the asset.

Figure 7:
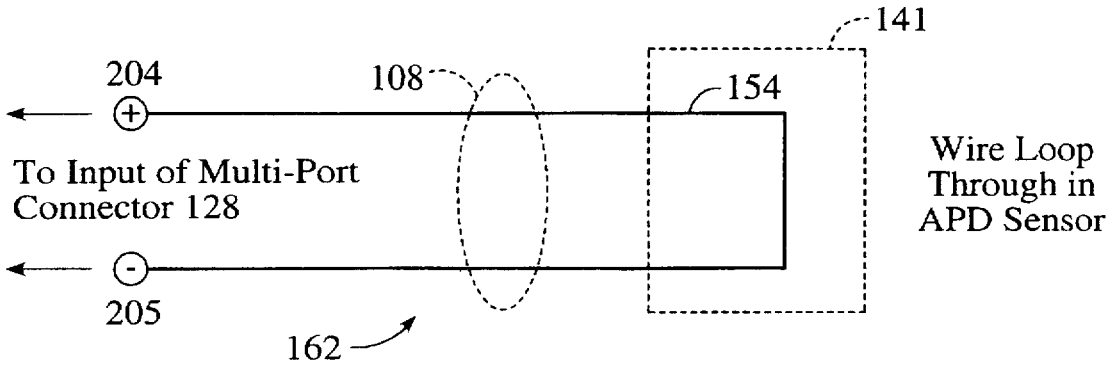
FIG. 7 is a schematic illustration of the equivalent circuit for a simple embodiment of an asset protection device anti-tamper sensor (APDS).
Figure 8:
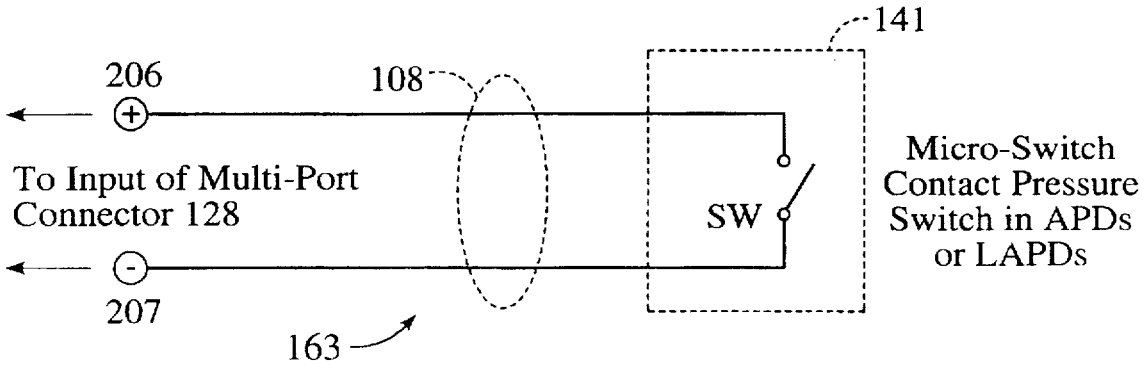
FIG. 8 is a schematic illustration of the equivalent circuit for another embodiment of an asset protection device anti-tamper sensor (APDS).

Two embodiments of the second remote asset protection circuits 162, 163 are illustrated in FIGS. 7–8. This remote asset protection circuit may be coupled via the multi-port connector 128 to either the alarm sensing module 132 or the tamper sensing module 311, depending upon the type of detection and signaling desired. In simplest form, a wire loop 159 extends between two terminals 204 and 205. If the wire is cut, the break in electrical continuity results in a stop in current flow and a low (e.g. 0 volt) to high (e.g. 3.6 volt) voltage transition at the input port of the tamper or alarm sensing module 131, 132 and causes wireless transmitter 117 to transmit a corresponding signal. Advantageously, a wire loop to and from each asset is serially connected as illustrated, for example, in FIGS. 9 and 11–13, so that a break in any one loop triggers a alarm and/or tamper condition. Although not required, this serial implementation reduces the number of components and the cost to implement, particularly since only a single port of the tamper or alarm sensing module of the wireless transmitter is required.

Figure 3:
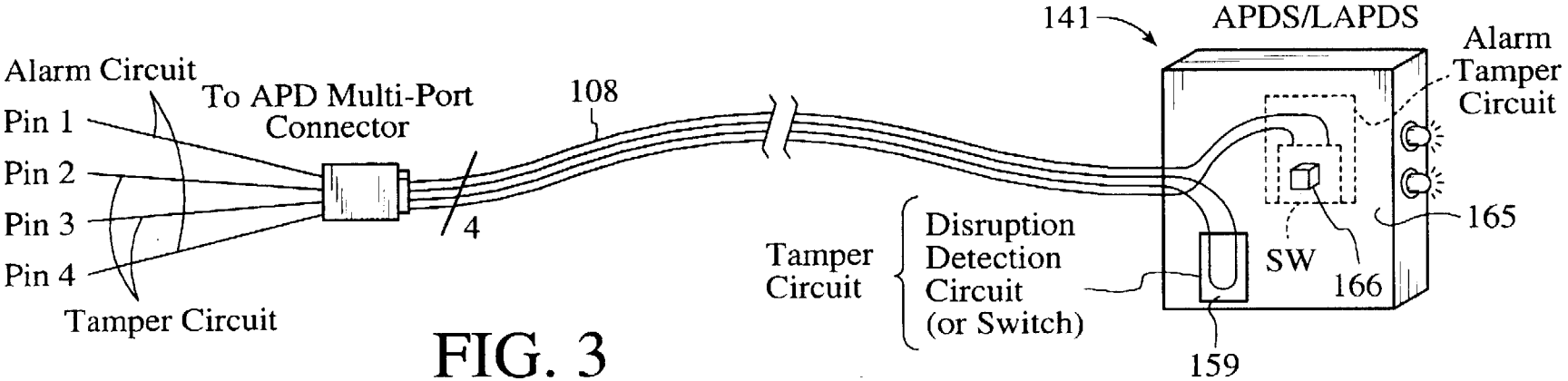
FIG. 3 is a diagrammatic illustration showing an asset protection device sensor module, 4-wire coupling cord, and multi-port connector.

The third circuit 163 comprises pressure contact switch, such as a micro-switch with a normally extended spring loaded plunger at the end of coupling cord 108, as illustrated in FIGS. 3 and 4. As illustrated in FIG. 8, this is simply a electrical wire loop with a switch. When the APDS or LAPDS is mounted to the asset surface 156 via an adhesive pad 165, the plunger 166 is depressed thereby closing the circuit. Continuity is maintained unless the APDS or LAPDS is removed from the asset, in which case the plunger 166 extends thereby opening the circuit, disrupting current flow around the loop, and allowing a voltage potential to develop between terminals 206 and 207. The change in voltage triggers an alarm or tamper condition in the transmitter sensing module as already described. The switches from each APDS or LAPDS may be wired serially to reduce logic and component costs.

An Asset Protection Device Sensor (APDS or LAPDS) 141 may contain any combination of two wire-loops or switches. The preferred embodiment of the invention includes two micro-switched, one coupled via pins 1 and 4 and the other coupled via pins 2 and 3 to the alarm and tamper circuits respectively. These represent two independent circuits. The LAPDS is essentially the same as the APDS except that it has a shorter cord 108 (coupled to a longer cord with an RJ-11 modular coupler) so that it can be detached from the APD and carried with the laptop computer without being a nuisance. A key-switch (See, for example, FIGS. 5 and 9) to by-pass an APD port is provided for coupling the LAPDS so that the asset may be disconnected without tiggering an alarm and/or tamper condition.

Figure 9:
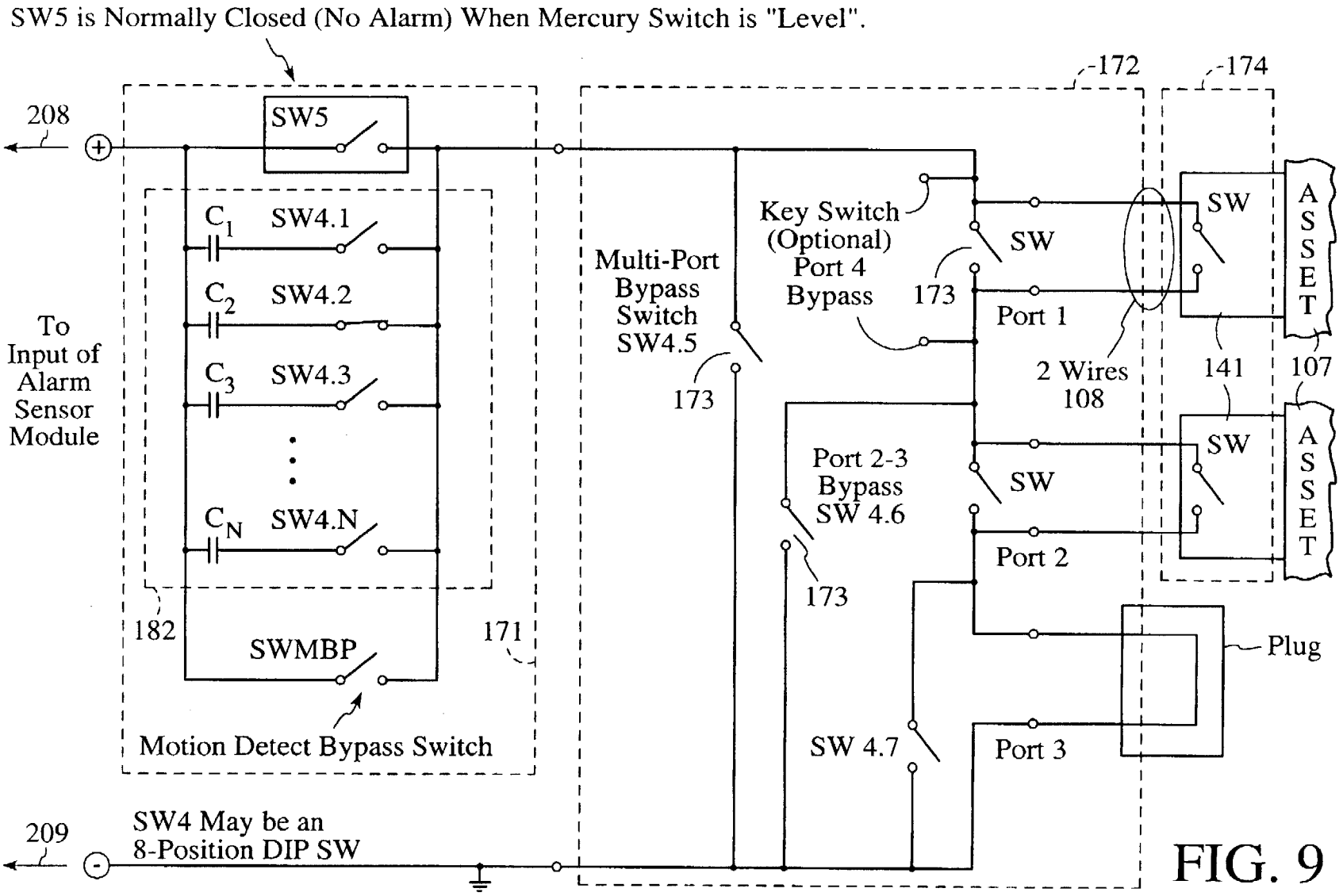
FIG. 9 is a schematic illustration of the equivalent alarm circuit for a simple embodiment of the APD.

FIG. 9 illustrates an embodiment of the alarm sensing circuit including the motion sensitivity adjustment circuit 129 and the remote asset alarm circuit. Here, the motion detection circuit 171 including mercury switch SW5 is contained within the APD housing and is serially connected to the remote asset alarm circuit 172 comprising a plurality of conductive wire loops extending from multi-port 128 via cords 108 to APDS 141. Clip type plugs and sockets such as are used for modular telephones are advantageously used for these connections. The figure also shows an optional port disabling switching network 173. The switching network provides means for the configurable multi-port connector module 128, internal to the APD housing, to enable or disabling one or more of the ports 109. For this circuit, any motion sufficient to open the mercury switch 301 or any disruption of the electrical continuity between the two terminals of an activated asset port (not disabled by a switch) will result in a change in the voltage and current flow between terminals 208 and 209 which is detected by either tamper module 131 or alarm sensor module 132. This change results in a transmission by transmitter 117.

Figure 11:
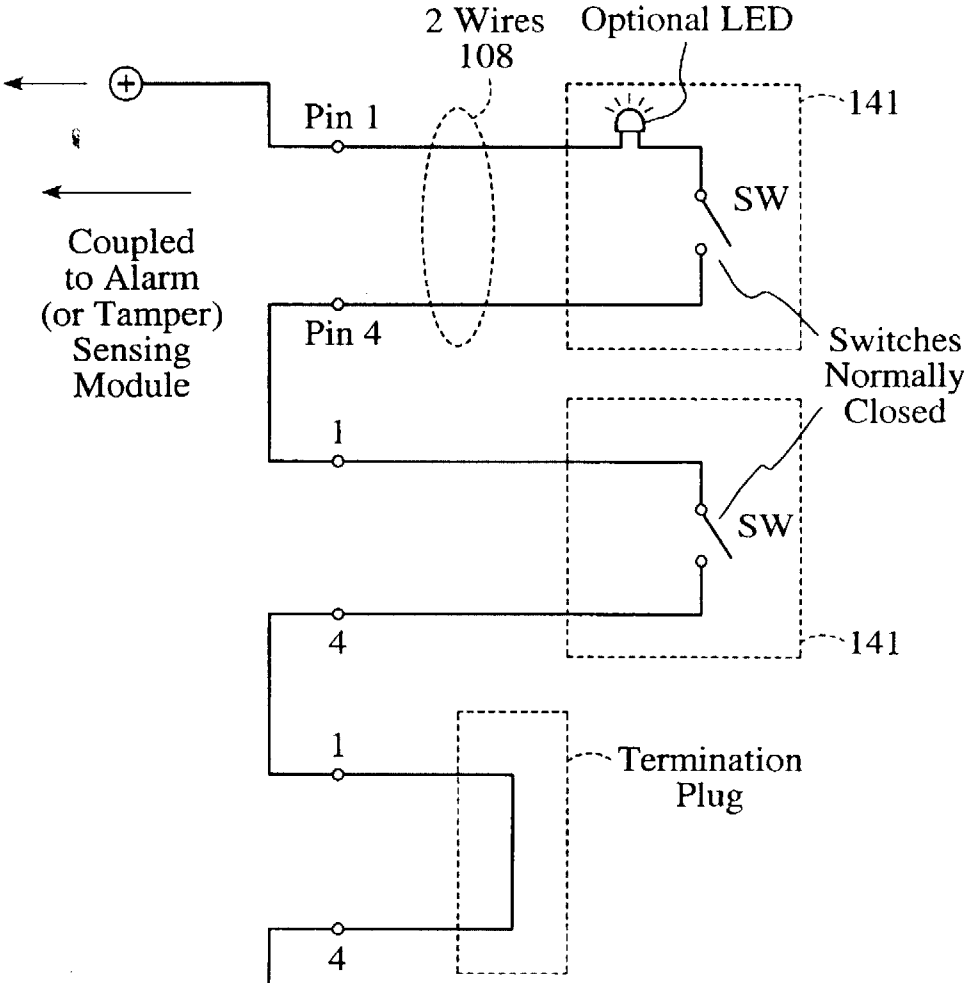
FIG. 11 is a schematic diagram of the equivalent circuit for a simple embodiment of the protected asset anti-tamper circuit wherein each anti-tamper circuit includes a simple wire loop for maintaining current flow between two terminals.
Figure 10:
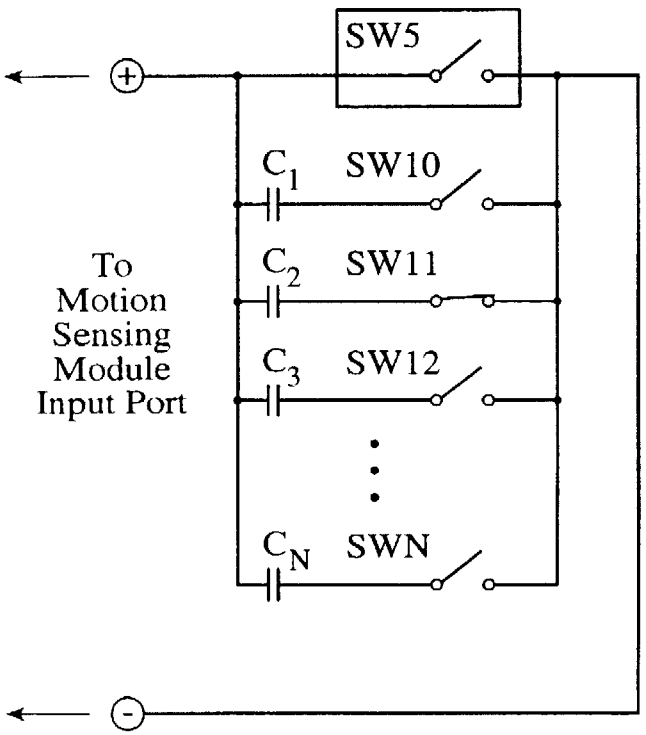
FIG. 10 is a schematic illustration of the equivalent circuit for a simple embodiment of the motion sensor circuit sensitivity adjustment circuit according to one embodiment of the invention.
Figure 12:
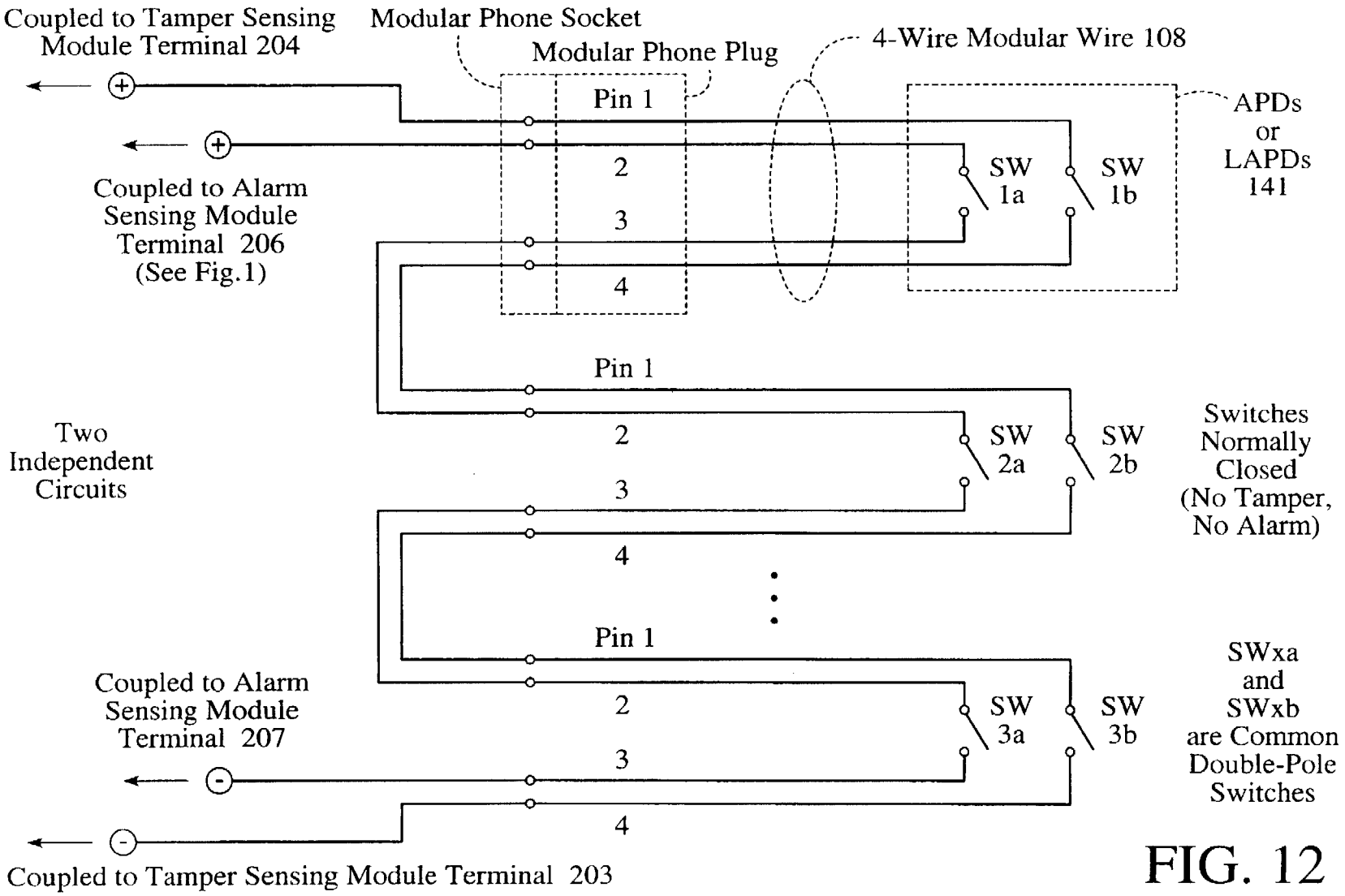
FIG. 12 is a schematic diagram of the equivalent circuit for a different embodiment of the circuit in the APD.

FIG. 10 illustrates an independent motion sensing circuit for the APD, independent of the other remote asset protection circuits, which is essentially the same circuit discussed with respect to FIG. 9. FIG. 11 is a simple embodiment of a remote asset protection circuit that could also be used to couple serially with the motion detection circuit of FIG. 9. FIG. 12 provides two parallel circuits for coupling to both the tamper sensor module 131 and the alarm sensor module 132 simultaneously.

Figure 13:
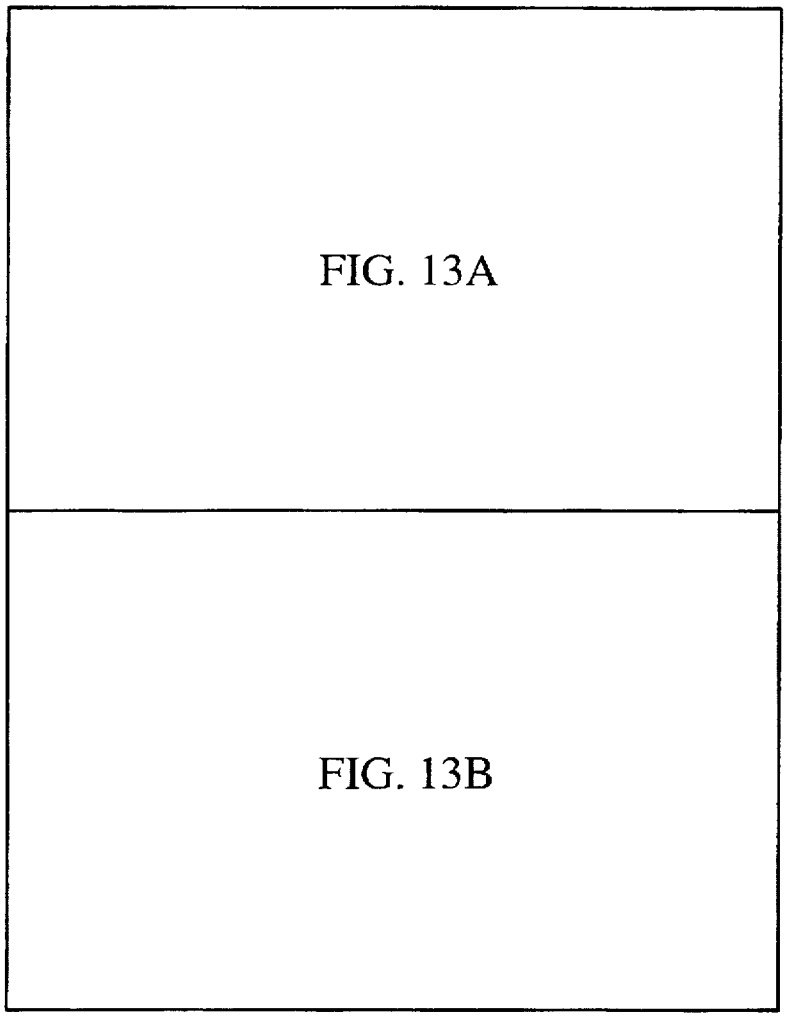
FIG. 13 is a schematic diagram of the equivalent circuit for a preferred embodiment of the invention including motion detection circuit with sensitivity adjust and by-pass, ADP module anti-tamper circuitry, remotely connected asset protection sensors, and port-bypass circuitry.
Figure 13A:
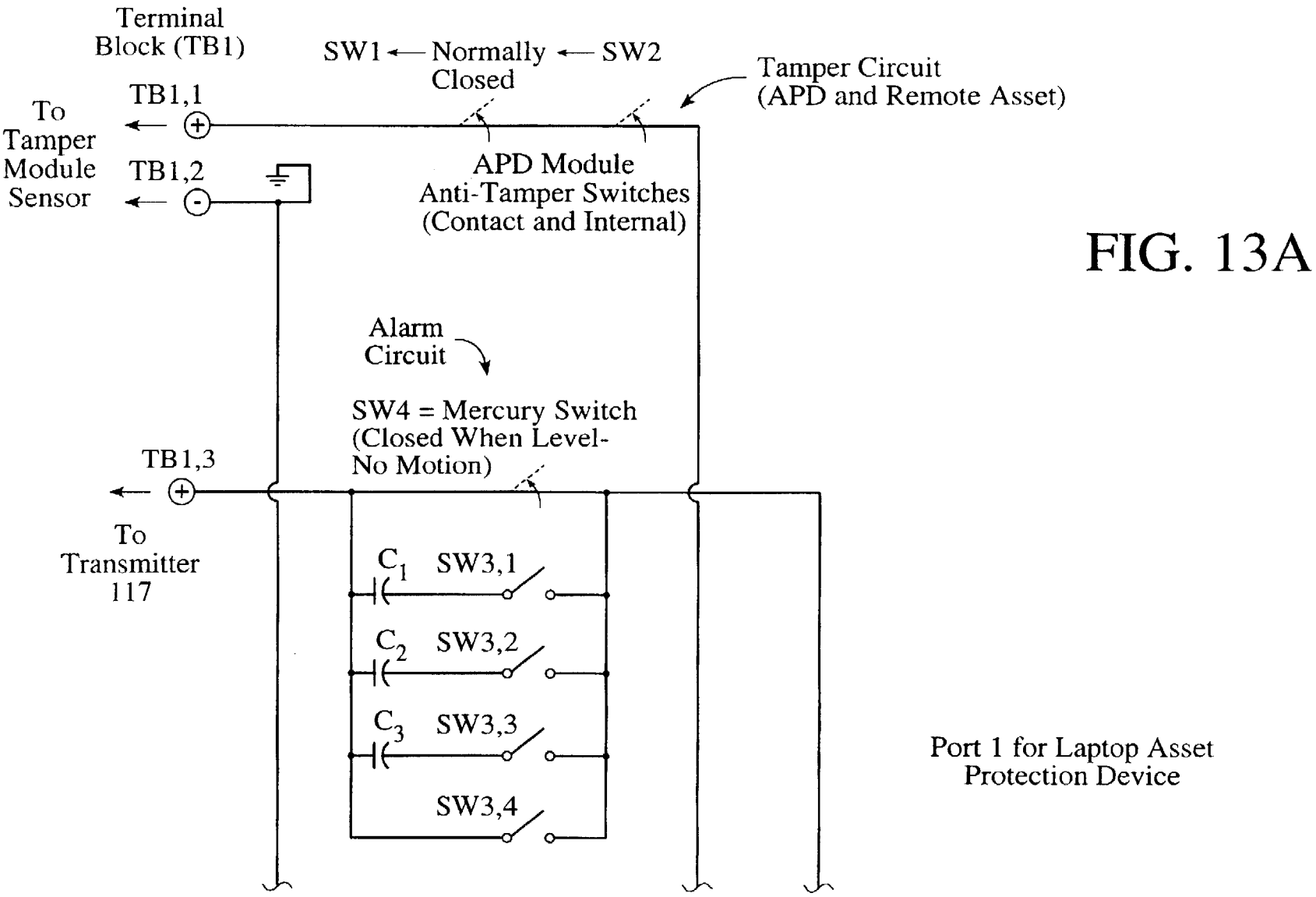
Figure 13B:
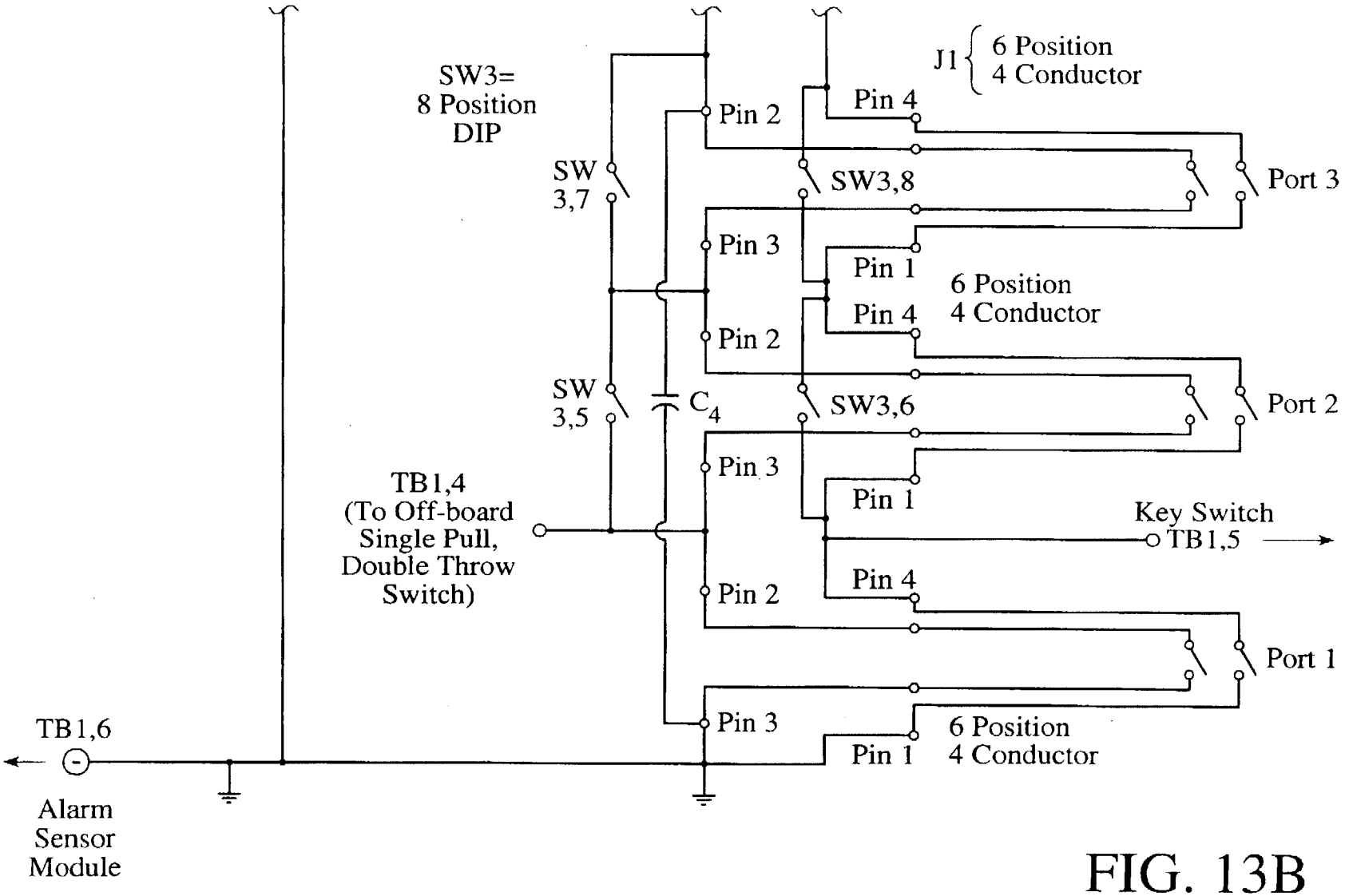

FIG. 11 also shows a APDS 141 having an optional LED warning light that show proper functioning of the unit and act as a deferent to would-be thieves. Each of the alarm and tamper sensor module circuits uses a separate input connector on wireless transmitter 117. Suitable transmitters 117 include the Ademco Model No. 5816 (miniature 2-zone transmitter), and the Ademco Model No. 5817 (miniature 3-zone transmitter). Of course other transmitters having only one zone or having more than three zones may be provided where required, and multiple transmitters may also be provided. The embodiment illustrated in FIG. 13 is a three-port single-zone implementation that provides the alarm sensing and tamper sensing already described.

Those workers having ordinary skill in the art in light of this description will understand that the system may sense other significant changes in electrical characteristics, such as for example a break in the circuit, such that the voltage or current characteristics through or across terminals alarm or tamper (e.g. 203 and 204, or 206 and 207 in FIG. 1), trigger a transmission condition in wireless transmitter 117. The break in electrical continuity occurs when the protected asset 107 is disconnected from the APD, the coupling cord 108 is cut, or the electrical characteristics are altered in such a manner that the voltage transition or current flow interruption triggers an alarm or tamper condition. As shown for example, in FIGS. 12 and 13, a tamper circuit within sensor module 131 located within the APD housing is extended via cords 108 to the APDS or LAPDS attached to assets 107.

An embodiment of the motion sensor circuit 113 is now described with respect to FIG. 9. The motion sensor circuit detects motion (e.g. tilt) of APD 102 and the asset connected directly to it only by virtue of the opening of the mercury switch contact. But since the APD is fixedly attached to at least one asset, motion of that asset is necessarily detected. The other assets are electrically connected to the APD and therefore can only be moved within a range limited by the cord length. The physical isolation between electrically connected assets advantageously permits some freedom of motion in using a protected asset. For example, typing at a connected keyboard will not trigger a motion related alarm from the induced vibration, but disconnection of the electrical coupling cord from the APD will result in a tamper and/or alarm condition.

With further reference to FIG. 9, the motion detection circuit 113 includes a normally closed (at level orientation) Mercury switch SW5 301 connected in parallel with a switchable bank of capacitors $C_1$, $C_2$, $C_3$, . . . , $C_N$ each connected in parallel through a selectable switching network SW4 (SW4.1, SW4.2, SW4.3), preferably implemented with a multi-position DIP switch array to deduce size and cost. A motion detection bypass switch SW4.4 may be provided in parallel with the mercury switch to bypass and effectively disable the motion sensing portion of the alarm circuit operation. This may be advantageous when an asset is relatively immobile but subject to bumping or vibration that may generate a false alarm; however, in this scenario, only the electrical connection provided by sensing cords 108 would protect the asset from disruption or removal.

The Mercury Switch 301 is conventional and provides switch opening or closing in response to the relative orientation of the switch contacts and the pool of liquid conductive mercury. Opening the mercury switch allows the voltage between the terminals 205 and 206 to rise and triggers a motion related alarm condition from alarm sensing module 132 However, the capacitive network provides a selectable sensitivity (delay) setting means and also permits the motion sensitivity to be adjusted to the particular motion sensing module 132 in wireless transmitter 117 characteristics so that motion detection sensitivity is user selectable and independent of ADP component tolerances and component variation.

The sensitivity selection is achieved by altering the time delay between the moment the mercury switch opens and the moment the voltage between terminals 205 and 206 rises to a sufficiently high voltage (about 1.7 volts) for motion sensing module 132 of transmitter 117 to detect the voltage and/or current change and trigger a transmission. For example, if the user desires that sensitivity for all APD's in the facility be set at a particular common sensitivity level so that each experiences about the same delay between disruption and alarm trigger, then by selecting one, some, or all of the capacitors in the network via the switches, each motion sensing circuit in the APD may be adjusted to provide about the same delay characteristics. In one embodiment of the invention, these switches are advantageously implemented by an array of DIP switches and the notation 4.1 refers to switch package number 4, switch position 2, and so forth.

In the preferred embodiment of the invention, the motion is detected with a mercury switch that is sensitive to about a 7-degree angular tilt from horizontal in any direction (360-degree coverage). Commercial varieties are commonly referred to as a tip-over switch. Other motion detection means may alternatively be used.

The capacitance values of capacitors $C_1$, $C_2$, $C_3$, . . . , $C_N$ are additive so that both a large range of capacitance (and therefore a large dynamic range of sensitivity) may be achieved by switching into the motion sensor circuit one or more relative large capacitors, and fine control over the sensitivity by switching into the circuit one or more relatively small capacitances. In one embodiment of the invention, capacitors are provided having capacitance values of 0.47 micro-farad, 0.68 micro-farad, and 1.0 micro-farad. Of course more or fewer capacitors may be provided depending on the particular operating environment, and different capacitance values may be provided to provide greater range or finer graduation of sensitivity.

With respect to the diagram in FIG 9, switches SW4.6, SW4.7, SW4.5 are provided to switch any one or combination of all of the ports 109 (e.g. 109A, 109B, 109C) on and off. Ports that are "on" but have no asset connected are an open circuit and the alarm and/or tamper (depending upon the chosen implementation) will be triggered under such conditions. The switches that enable or disable ports are enclosed within the APD and cannot be altered without opening the APD housing. In a particular embodiment of the system designed for use with a notebook computer or other portable asset, an externally accessible key-switch SW3.1 is provided so that by inserting and turning a key in a key-lock, the port (e.g. Port 1) to which the notebook computer is attached may be deactivated without causing an alarm condition while other assets remain protected by motion sensor and sensing cord connected APDS.

In one embodiment of the invention, the Wireless Receiver 103 comprises the Model SX-V Wireless Alarm Receiver made by Interactive Technologies Incorporated, 2266 North Second Street, North St. Paul, Minn. 55109. The SX-V Wireless Receiver receives wireless signals from any of one or more APDs and responds to the received signals in a manner that is dependent on their programming. In a 24-hour programmed mode,the APDs will result in an immediate transmission (via phone lines) to the CS4000 Central Station Receiver identifying the nature of the condition (alarm or tamper) and the asset location via the APD ID. A local audible alarm, such as a siren, or a visual alarm such as a flashing light, may also be programmed to activate when an asset is disturbed. Each SX-V can monitor up to 99 Wireless Asset Protection Devices.

Furthermore, in this same embodiment, the Central Station Receiver (an optional element of the APS) is the Model CS4000 Central Station Receiver made by Interactive Technologies Incorporated, 2266 North Second Street, North St. Paul, Minn. 55109. The CS4000 communicates with the SX-V via telephone lines and deciphers information on APDs which are stored in the SX-V's memory. The CS4000 is also used to program the SX-V receivers; specifically the type of alarm, phone test time, and initializing and deleting APDs from the configuration. Each CS4000 can accept signals from up to 1000 SX-V units.

This same embodiment also includes ABM Personal Computer (PC) monitoring Software as an optional component of the APS. The AMB Software is supplied by ABM Data Systems Inc., in conjunction with the CS4000 and/or SX-V units. The ABM Software is a database and asset tracking application used to store user information (e.g. name, location, telephone number) and create alarm tickets or reports when an alarm occurs. Each alarm ticket is time and date stamped. The PC connects to the CS4000 via an RS-232 interface.

Having described the above embodiment of the invention, it can be appreciated that the objects of the present invention can be fully achieved thereby. It will also be understood by those of skill in the art in light of the description contained herein that changes in construction and different embodiments of the application will suggest themselves without departure from the spirit and scope of the invention. The disclosures and description herein are illustrative and are not intended to be in any sense limiting. The scope of the present invention is intended to be defined by the following claims. All references and publications mentioned herein are hereby incorporated by reference.

What is claimed is:

1. An asset protection system (APS) for protecting an asset comprising:

(A) a battery-powered self-contained asset protection device (APD) including:

(a) a housing having a case portion and a cover portion fastenable to said case portion to form an enclosure;

(b) means for storing a unique asset protection device identifier;

(c) a wireless radio-frequency transmitter disposed internal to said enclosure, including an alarm sensing module for receiving alarm circuit detection signals and a tamper sensing module for receiving tamper circuit detection signals, and for transmitting APD status information including transmitting information indicating that an alarm condition is sensed, that a tamper condition is sensed, and said unique APD identifier;

(d) said alarm sensing module being responsive to a first predetermined change in voltage/current characteristics at input terminals of said alarm module to transmit an alarm sensed signal, and said tamper sensing module being responsive to a second predetermined threshold change in voltage/current characteristics at input terminals of said tamper module to transmit a tamper sensed signal;

(e) an alarm detection circuit disposed internal to said enclosure for detecting an alarm condition, including an adjustable sensitivity motion detection circuit internal to said APD for detecting mechanical motions of said APD and an attached asset, said alarm detection circuit being coupled to said alarm sensing module input terminals and providing a voltage/current characteristic greater than or equal to said predetermined voltage/current characteristic at said input terminals when an alarm condition is detected;

(f) a tamper detection circuit disposed internal to said enclosure for detecting a tamper condition, including a first switch disposed internal to said enclosure and extending partially through said enclosure to contact said asset for detecting physical removal of said APD and first switch from said asset and a second switch disposed entirely within said enclosure for detecting removal of said cover from said enclosure, said tamper detection circuit being coupled to said tamper sensing module input terminals and providing a voltage/current characteristic greater than or equal to said predetermined tamper voltage/current characteristic at said input terminals when a tamper condition is detected; and (g) a configurable multi-port coupling circuit disposed internal to said enclosure including a plurality of asset coupling ports having at least two terminals for coupling a plurality of assets to said APD, and at least one port by-pass switch for selectively disabling one of said plurality of ports not being used to protect an asset.

2. The system in claim 1, further comprising:

(B) a wireless receiver for receiving said APD status information from said wireless transmitter;

(C) transmitter means receiving said APD status information from said wireless receiver and communicating said information to a central station receiver;

(D) a central station receiver receiving said information from said transmitter means;

(E) a processing unit coupled to said central station receiver for processing said information and for generating a response to a tamper and alarm condition.

3. The system in claim 1, wherein said motion detection circuit further comprising:

a motion detection device including a mechanical motion sensor operable to change states between a first and second state in response to a motion of said APD, and motion detection circuity for responding to said change in state to generate a motion detected signal, said motion detected signal coupled to said two input terminals of said alarm sensing module.

4. The system in claim 3, wherein said motion sensor includes a mercury switch operable to change between open and closed switch states.

5. The system in claim 1, further including at least one remote asset protection device sensor electrically connected to said APD by a conductive cord having at least two conductors for extending said tamper circuit from two terminals within said tamper sensing module of said wireless transmitter from a first terminal of one of said plurality of ports via a first conductive wire loop through said remote sensor back to said second terminal of said port; said extended tamper circuit providing a tamper indication if said conductive cord is cut.

6. The system of claim 5, wherein said remote sensor includes a conductive wire that maintains electrical continuity between said first and second terminals.

7. The system of claim 5, wherein said remote sensor includes a pressure sensitive switch that maintains electrical continuity between said first and second terminals when said sensor is attached to said asset but breaks electrical continuity when said sensor is removed from said asset.

8. The system of claim 7, wherein said remote sensor further includes a light emitting diode that illuminates to provides a warning to thieves and vandals.

9. The system in claim 1, further including at least one remote asset protection device sensor electrically connected to said APD by a conductive cord having at least two conductors for extending said alarm circuit from two terminals within said alarm sensing module of said wireless transmitter from a third terminal of one of said plurality of ports via a second conductive wire loop through said remote sensor back to said fourth terminal of said port; said extension of said alarm circuit providing an alarm indication if said conductive cord is cut or unplugged.

10. The system of claim 5, wherein said remote sensor includes a conductive wire that maintains electrical continuity between said first and second terminals.

11. The system of claim 5, wherein said remote sensor includes a switch that maintains electrical continuity between said first and second terminals when said sensor is attached to said asset but breaks electrical continuity when said sensor is removed from said asset.

12. The system in claim 5, further comprising:

At least one remote electrical cord coupled asset protection device sensor electrically connected to said APD by a conductive cord having at least four conductors for extending said tamper circuit from said two terminals within said tamper sensing from a first terminal of one of said plurality of ports via a first conductive wire loop through said remote sensor back to said second terminal of said port, and for extending said alarm circuit from said two terminals within said alarm sensing module of said wireless transmitter from a third terminal of said port via a second conductive wire loop through said remote sensor back to said fourth terminal of said port; said extension of said alarm and tamper circuits to said sensor via said first and second wire loops providing redundant tamper and alarm circuit protection to said cord coupled asset.

13. The system of claim 12, wherein said remote sensor includes a switch that maintains electrical continuity between said first and second terminals when said sensor is attached to said asset but breaks electrical continuity when said sensor is removed from said asset.

14. The system in claim 12, wherein each of said asset coupling ports include a modular telephone-type socket having at least two contacts, and wherein said conductive cord is a modular telephone cord having modular plug clips at each of two ends.

15. The system in claim 4, wherein said motion detection means further includes a motion sensitivity adjustment means for adjusting the motion detection sensitivity of said APD by adjusting a delay period between the occurrence of a disturbing motion and generation of said alarm detection signal, said motion sensitivity adjustment means comprising a plurality of capacitors disposed within said APD housing, a plurality of switches for selectively connecting a selected one or selected ones of said capacitors into a voltage accumulation circuit in parallel across two terminals of said motion sensor, a period of time required to accumulate said voltage corresponding to said delay period and to said predetermined alarm module threshold voltage so that said alarm detection signal is not generated until said threshold voltage is exceeded.

16. The system in claim 1, wherein the ADP has external dimensions of about 4 inches by about 2 inches by about 1 inch, and wherein said battery is a lithium cell supplying about 3.6 volts.

17. The system in claim 1, wherein said wireless transmitter transmits a digitally encoded signal, identifying an alarm detection condition or a tamper condition, and the identity of the APD sending the signal.

18. The system in claim 1, wherein said wireless receiver is configured to responds to receipt of an alarm condition or a tamper condition by an action selected from the group consisting of activation of an audible signal, activation of a visual signal, activating a telephone line transmitter to send an alarm message over a communication channel, and combinations thereof.

19. The system in claim 5, further comprising a key-operated switch for disabling at least one of said ports from the exterior of said APD so that said at least one port may be disabled by an authorized person to remove an asset protected by said at least one port without causing a tamper or alarm condition.

20. A battery-powered asset protection device (APD) comprising:

a housing having a case portion and a cover portion fastenable to said case portion to form an enclosure;

a wireless radio-frequency transmitter disposed internal to said enclosure for receiving alarm and tamper circuit detection signals and for transmitting APD status information including information indicating that an alarm and/or tamper condition is sensed;

said wireless radio-frequency transmitter being responsive to a predetermined change in voltage/current characteristics at input terminals of said transmitter to transmit a signal indicating an alarm and/or tamper condition;

an alarm detection circuit for detecting an alarm condition coupled to said transmitter input terminals and providing a voltage/current characteristic greater than or equal to said predetermined voltage/current characteristic at said input terminals when an alarm condition is detected;

a tamper detection circuit for detecting a tamper condition coupled to said transmitter input terminals and providing a voltage/current characteristic greater than or equal to said predetermined tamper voltage/current characteristic at said input terminals when a tamper condition is detected;

an adjustable sensitivity vibratory motion detector for detecting motion of said APD coupled to said alarm detection circuit; and a configurable multi-port coupling circuit including a plurality of asset coupling ports each having at least two terminals for coupling a plurality of assets to the APD, and at least one port by-pass switch for selectivlely disabling one of said plurality of ports not being used to protect an asset.

21. A low-power consumption battery-powered self-contained asset protection device (APD) comprising:

a housing having a case portion and a cover portion fastenable to said case portion to form an enclosure;

means for storing a unique asset protection device identifier;

a wireless radio-frequency transmitter disposed internal to said enclosure, including an alarm sensing module for receiving alarm circuit detection signals and a tamper sensing module for receiving tamper circuit detection signals, and for transmitting APD status information including transmitting information indicating that an alarm condition is sensed, that a tamper condition is sensed, and said unique APD identifier;

said alarm sensing module being responsive to a first predetermined change in voltage/current characteristics at input terminals of said alarm module to transmit an alarm sensed signal, and said tamper sensing module being responsive to a second predetermined threshold change in voltage/current characteristics at input terminals of said tamper module to transmit a tamper sensed signal;

an alarm detection circuit disposed internal to said enclosure for detecting an alarm condition, including an adjustable sensitivity motion detection circuit internal to said APD for detecting mechanical motions of said APD and an attached asset, said motion detection circuit including a 360-degree tip-over mercury switch operable to change states between a conducting and nonconducting state in response to a motion of said APD, said alarm detection circuit including said motion detection circuit being coupled to said alarm sensing module input terminals and providing a voltage/current characteristic greater than or equal to said predetermined voltage/current characteristic at said input terminals when an alarm condition is detected;

a tamper detection circuit disposed internal to said enclosure for detecting a tamper condition, including a first switch disposed internal to said enclosure and extending partially through said enclosure to contact said asset for detecting physical removal of said APD and first switch from said asset and a second switch disposed entirely within said enclosure for detecting removal of said cover from said enclosure, said tamper detection circuit being coupled to said tamper sensing module input terminals and providing a voltage/current characteristic greater than or equal to said predetermined tamper voltage/current characteristic at said input terminals when a tamper condition is detected;

a configurable multi-port coupling circuit disposed internal to said enclosure including a plurality of asset coupling ports having at least two terminals for coupling a plurality of assets to said APD, and at least one port by-pass switch for selectively disabling one of said plurality of ports not being used to protect an asset.

a plurality of remote asset protection device sensors electrically connected to said APD by a conductive modular telephone cord having at least two electrical conductors for extending said tamper circuit from two terminals within said tamper sensing module of said wireless transmitter from a first terminal of one of said plurality of ports via a first conductive wire loop through said remote sensor back to said second terminal of said port; said remote sensor further including a spring loaded plunger-type switch that maintains electrical continuity between said first and second terminals when said sensor is attached to said asset but breaks electrical continuity when said sensor is removed from said asset so that said plunger extends; and said motion detection means further includes a motion sensitivity adjustment means for adjusting the motion detection sensitivity of said APD by adjusting a delay period between the occurrence of a disturbing motion and generation of said alarm detection signal, said motion sensitivity adjustment means comprising a plurality of capacitors disposed within said APD housing, a plurality of switches for selectively connecting a selected one or selected ones of said capacitors into a voltage accumulation circuit in parallel across two terminals of said motion sensor, a period of time required to accumulate said voltage corresponding to said delay period and to said predetermined alarm module threshold voltage so that said alarm detection signal is not generated until said threshold voltage is exceeded.

* * * * *